US006213794B1

(12) United States Patent
Okabe et al.

(10) Patent No.: US 6,213,794 B1
(45) Date of Patent: Apr. 10, 2001

(54) LEVER FITTING-TYPE CONNECTOR

(75) Inventors: Toshiaki Okabe; Tetsuya Yamashita, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/369,889

(22) Filed: Aug. 9, 1999

(30) Foreign Application Priority Data

Aug. 10, 1998 (JP) ..... 10-226235

(51) Int. Cl.[7] ..... H01R 13/62
(52) U.S. Cl. ..... 439/157; 439/160
(58) Field of Search ..... 439/157, 155, 439/152, 372, 160

(56) References Cited

U.S. PATENT DOCUMENTS 5,711,682 * 1/1998 Maejima ..... 439/157
5,888,081 * 3/1999 Konoya et al. ..... 439/157
5,964,604 * 10/1999 Kashiyama et al. ..... 439/157
5,980,283 * 11/1999 Okabe ..... 439/157

* cited by examiner

*Primary Examiner*—Brian Sircus
*Assistant Examiner*—Son V. Nguyen
(74) *Attorney, Agent, or Firm*—Sughrue, Mion, Zinn, Macpeak & Seas, PLLC

(57) ABSTRACT

A lever fitting-type connector, wherein an operating force, required for pivotally moving a lever by leverage, so as to fit a connector into a mating connector, is reduced. A lever (22) is pivotally mounted on bosses (28) formed on a male connector (21), and the male connector (21) is fitted into a female (mating) connector (23) by pivotally moving the lever (22) with the bosses (28) serving as an application point. An operating portion (30), serving as a force-applying point for the pivotal movement of the lever (22), is formed at a rear end portion of the lever (22). Engagement projections (33) are formed respectively on opposite side walls (29) of the lever (22), and are disposed rather close to the bosses (28), respectively. Retaining holes (34) are formed in the mating connector (23), and the engagement projections (33) are retainingly engaged respectively in the retaining holes (34), so that the engagement projections (33) serve as a supporting point for the pivotal movement of the lever (22).

3 Claims, 4 Drawing Sheets

LEVER FITTING-TYPE CONNECTOR

BACKGROUND OF THE INVENTION

1. Field of the Invention

The present invention relates to a lever fitting-type connector in which a connector is fitted into a mating connector by pivotally moving a lever mounted on the connector.

2. Related Art

FIG. 5 shows a conventional lever fitting-type connector. This lever fitting-type connector comprises a male connector 1, a lever 2 pivotally mounted on the male connector 1, and a female connector 3 into which the male connector 1 is fitted. The male connector 1 has a plurality of terminal receiving chambers 4 for respectively receiving terminals therein, which terminal receiving chambers 4 extend through the male connector 1 in an upward-downward direction. Disengagement prevention ribs 6 are respectively formed on and project laterally from opposite side surfaces 5 of the male connector 1 at one end thereof, and extend in a connector-fitting direction. A slot 7 is formed between each of the disengagement prevention ribs 6 and the corresponding side surface 5, the slots 7 extending in the connector-fitting direction. Bosses 8 are also formed on and project from the opposite side surfaces 5 of the male connector 1, respectively. Each boss 8 is disposed generally centrally of the length of the male connector 1. The lever 2 is pivotally supported by these bosses 8.

The lever 2 includes a pair of right and left side walls 9, and an operating portion 10 interconnecting the right and left side walls 9. The right and left side walls 9 have rotation holes 11, respectively, in which the bosses 8 are inserted so that the lever 2 can be pivotally moved about the bosses 8. The operating portion 10 of the lever 2 interconnects the rear end portions of the right and left side walls 9, and this operating portion 10 is operated or pressed when fitting the connector. Front end portions of the right and left side walls 9 remote from the operating portion 10 serve as projected engagement portions 12, respectively. These projected engagement portions 12 are inserted respectively in the slots 7 in the male connector 1, and therefore will not be disengaged respectively from the disengagement prevention ribs 6, so that the lever 2 is prevented from being disengaged from the male connector 1.

The female connector 3 includes a hood portion 13 with an open top into which the male connector 1 is fitted. Engagement holes 15, in which the projected engagement portions 12 can be engaged, respectively, are formed in that surface 14 of the hood portion 13 which is to be opposed to the projected engagement portions 12. Elongate grooves 16 for respectively receiving the disengagement prevention ribs 6 of the connector 1 are formed respectively in opposite side surfaces of the hood portion 13.

In this lever fitting-type connector, the lever 2 is mounted on the male connector 1, as shown in FIG. 5, and the male connector and the lever in this assembled condition are inserted into the hood portion 13, and a fitting operation is effected. At this time, the disengagement prevention ribs 6 are inserted respectively into the elongate grooves 16, and by doing so, a gouging engagement between the connectors 1 and 3 can be prevented.

For fitting the connectors together, the projected engagement portions 12 of the lever 2, are passed respectively through the slots 7 in the male connector 1, and are engaged respectively in the engagement holes 15 in the hood portion 13, and in this engaged condition, the operating portion 10 is pressed. In this pressing operation, the lever 2 is pivotally moved through the leverage in which the operating portion 10 serves as a force-applying point, and the bosses 8 serve as an application point, and the projected engagement portions 12, engaged respectively in the engagement holes 15, serve as a supporting point. Therefore, the lever 2 and the male connector 1 is fitted in unison into the female connector 3.

In the lever fitting-type connector of the above construction, if it is desired to reduce the operating force required for the fitting operation, this can be effected by providing the projected engagement portions 12 (serving as the supporting point for the pivotal movement of the lever 2) at a point closer to the bosses 8. In this case, the projected engagement portions 12 serve as the supporting point for the pivotal movement, and also are inserted and engaged in the respective disengagement prevention ribs 6, thereby preventing the lever 2 from being disengaged from the male connector 1. Therefore, if the projected engagement projections 12 are disposed closer to the bosses 8, the disengagement prevention ribs 6 of the male connector 1 also need to be disposed closer to the bosses 8.

In this case, however, the disengagement prevention ribs 6 interfere with spacer openings 17 formed in the male connector 1, and therefore the disengagement prevention ribs 6 can not be disposed closer to the bosses 8. In the conventional lever fitting-type connector, the projected engagement portions 12, thus, need to be engaged respectively with the disengagement prevention ribs 6, and therefore this connector can not be designed so as to reduce the operating force, and hence has a disadvantage that it can not meet with the requirement of a multi-pole design requiring a large operating force.

SUMMARY OF THE INVENTION

It is therefore an object of the present invention to provide a lever fitting-type connector in which although projected engagement portions need to be engaged respectively with disengagement prevention ribs, an operating force, required for fitting two connectors together, is reduced so as to meet with the requirement of a multi-pole design.

The above object has been achieved by a lever fitting-type connector, wherein a lever is pivotally mounted on bosses formed on a connector, and the connector is fitted into a mating connector by pivotally moving the lever with the bosses serving as an application point; wherein an operating portion, serving as a force-applying point for the pivotal movement of the lever, is formed at a rear end portion of the lever; and engagement projections are formed respectively on opposite side walls of the lever, and are disposed rather close to the bosses, respectively; and retaining holes are formed in the mating connector, and the engagement projections are retainingly engaged respectively in the retaining holes, so that the engagement projections serve as a supporting point for the pivotal movement of the lever.

In this invention, the engagement projections, formed respectively on the opposite side walls of the lever, are disposed rather close to the bosses of the connector, respectively, and the engagement projections are retainingly engaged respectively in the retaining holes in the mating connector, so that the engagement projections serve as the supporting point for the pivotal movement of the lever.

Namely, the supporting point (the engagement projections) for the pivotal movement of the lever are disposed rather close respectively to the bosses serving as the application point, so that the distance between the supporting point and the application point is reduced. Therefore, the operating force, required for pivotally moving the lever with the operating portion serving as the force-applying point, can be reduced.

The engagement projections, serving as the supporting point for the pivotal movement of the lever, are thus, formed respectively on the opposite side walls of the lever so as to reduce the operating force. Therefore, projected engagement portions and disengagement prevention ribs, which cooperate with each other to prevent the lever from being disengaged from the connector, do not need to be changed in design, and the requirement for a multi-pole design can be met although the projected engagement portions and the disengagement prevention ribs are provided.

Further, gouging prevention ribs are formed respectively on opposite side surfaces of the connector, and are juxtaposed respectively to the engagement projections in a direction of fitting of the connector, and rib grooves for respectively receiving the gouging prevention ribs are formed in an inner surface of the mating connector, and the retaining holes communicate with the rib grooves, respectively.

In the present invention, the gouging prevention ribs, as well as the rib grooves for respectively receiving the gouging prevention ribs, are provided, and therefore the connector can be smoothly fitted into the mating connector. The engagement projections are provided in juxtaposed relation to the gouging prevention ribs, respectively, and also each of the retaining holes, in which the engagement projection can be retainingly engaged, communicates with the rib groove for receiving the gouging prevention rib. Therefore, by inserting the gouging prevention ribs respectively into the rib grooves, the engagement projections are engaged respectively in the retaining holes. Therefore, the engagement projections can be easily retained relative to the retaining holes, respectively.

Besides, each of the engagement projections is disposed in juxtaposed relation to the associated gouging prevention rib, and therefore, the engagement projections will not interfere with the mating connector, and therefore will not be damaged.

DESCRIPTION OF THE PREFERRED EMBODIMENTS

FIGS. 1 to 4 show one preferred embodiment of a lever fitting-type connector of the present invention. The lever fitting-type connector of this embodiment comprises a male connector 21, a lever 22 pivotally mounted on the male connector, and a female (mating) connector 23 into which the male connector 21 is fitted.

Figure 3:
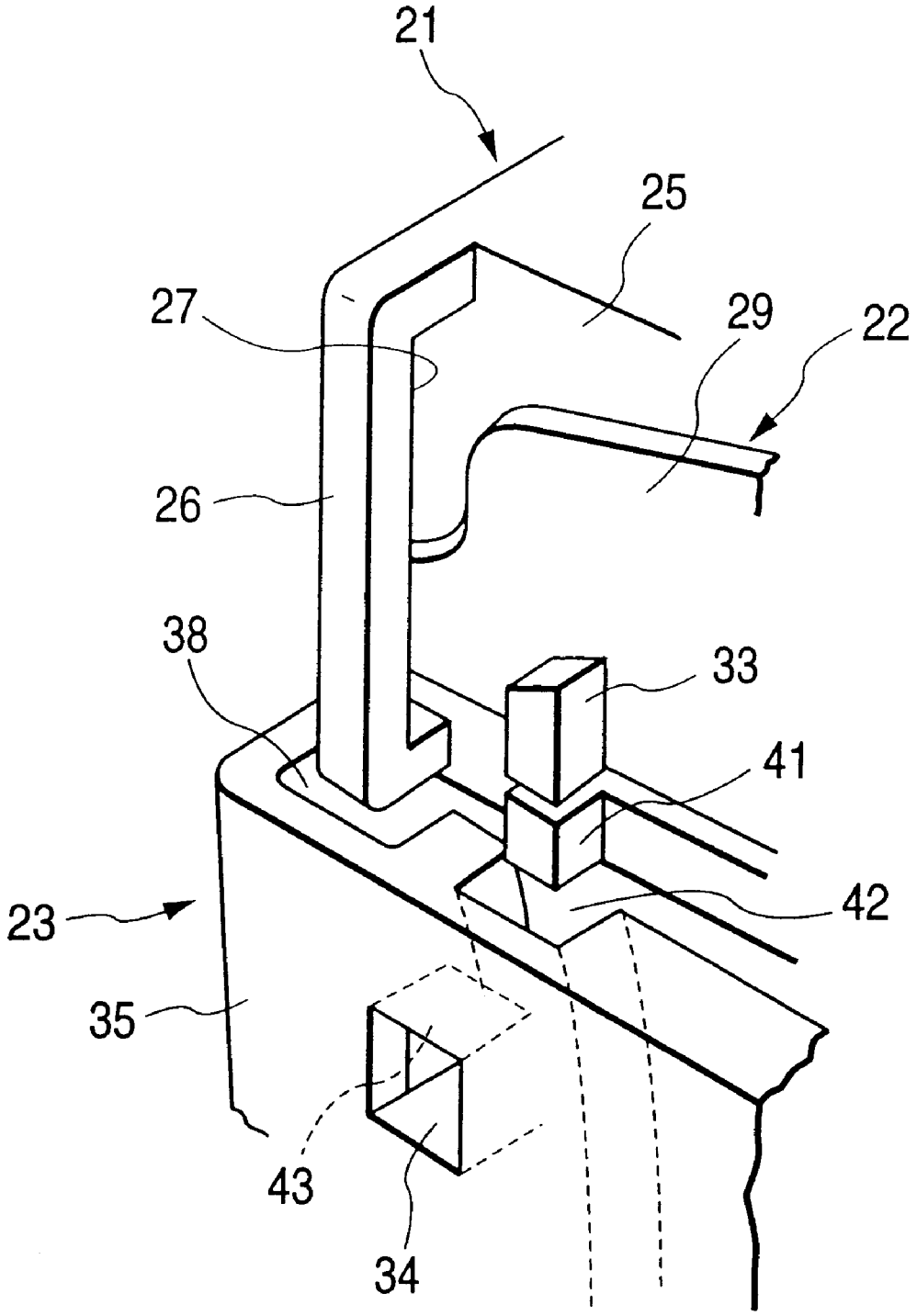
FIG. 3 is a perspective view showing an initial stage of fitting the male connector into a female connector.

Like the conventional male connector, the male connector 21 has a plurality of terminal receiving chambers for respectively receiving terminals therein. Disengagement prevention ribs 26 are respectively formed on and project laterally from opposite side surfaces 25 of the male connector at their one ends (front ends), these ribs 26 extending in a connector-fitting direction (upward-downward direction). As shown in FIG. 3, a slot 27 is formed between each of the disengagement prevention ribs 26 and the corresponding side surface 25, and extends in the connector-fitting direction (upward-downward direction). Bosses 28 are formed on and project from generally central portions of the opposite side surfaces 25 of the male connector 21, respectively, and the lever 22 is pivotally supported by the bosses 28. Thus, the bosses 28 serve as an application point for the pivotal movement of the lever 22.

Figure 2:
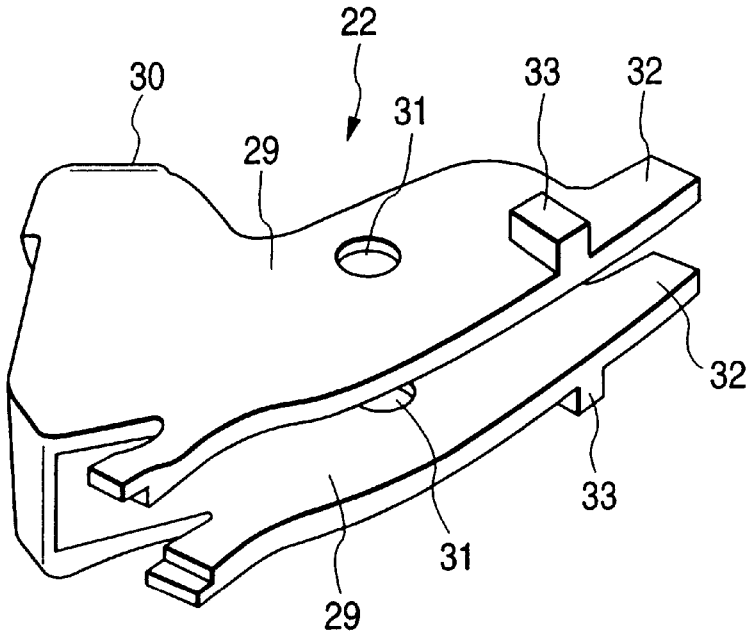
FIG. 2 is a perspective view of the lever.

As shown in FIG. 2, the lever 22 includes a pair of right and left side walls 29, and an operating portion 30 interconnecting the right and left side walls 29. Rotation holes 31 are formed respectively through the pair of right and left side walls 29, and the bosses 28 of the male connector 21 are inserted respectively in the rotation holes 31.

When the two connectors are to be fitted together, the operating portion 30 of the lever 22 is operated or pressed to pivotally move the lever 22, and at this time, the operating portion 30, interconnecting rear end portions of the right and left side walls 29, serves as a force-applying point. Projected engagement portions 32 are formed respectively on front ends of the right and left side walls 29 remote from the operating portion 30, and these projected engagement portions 32 are inserted respectively in the slots 27 in the male connector 21, and therefore are engaged respectively with the disengagement prevention ribs 26. The projected engagement portions 32 are thus engaged respectively with the disengagement prevention ribs 26, and with this construction, the lever 22 is prevented from being disengaged from the male connector 21, so that the condition of mounting of the lever 22 on the male connector 21 is stable.

Engagement projections 33 are formed on and project from the right and left side walls 29 of the lever 22, respectively. Each engagement projection 33, formed on the side wall 29, is disposed closer to the boss 28 than the projected engagement portion 32 (formed at the front end of the lever 22). The engagement projections 33 serve as a supporting point at the time of pivotal movement of the lever 22 as described later. Engagement (retaining) holes 34 are formed in the female connector 23, and the engagement projections 33 are engaged respectively in these engagement holes 34 so that the engagement projections 33 can serve as the supporting point for the pivotal movement.

Like the conventional female connector, the female connector 23 has a hood portion 35 with an open top into which the male connector 21 is fitted. Engagement holes 37, in which the projected engagement portions 32 can be engaged, respectively, are formed in a front wall 36 of the hood portion 35 which is to be opposed to the projected engagement portions 32 of the lever 22. Elongate grooves 38 for respectively receiving the disengagement prevention ribs 26 of the male connector 21 are formed respectively in opposite side surfaces of the hood portion 35 (see FIG. 4). A plurality of terminal insertion holes 40 for the passage of mating terminals therethrough are formed through a bottom wall 39 of the hood portion 35.

In this embodiment, gouging prevention ribs 41 are formed on and project from the male connector 21, and rib grooves 42 for respectively receiving the gouging prevention ribs 41 are formed in the female connector 23.

Figure 1:
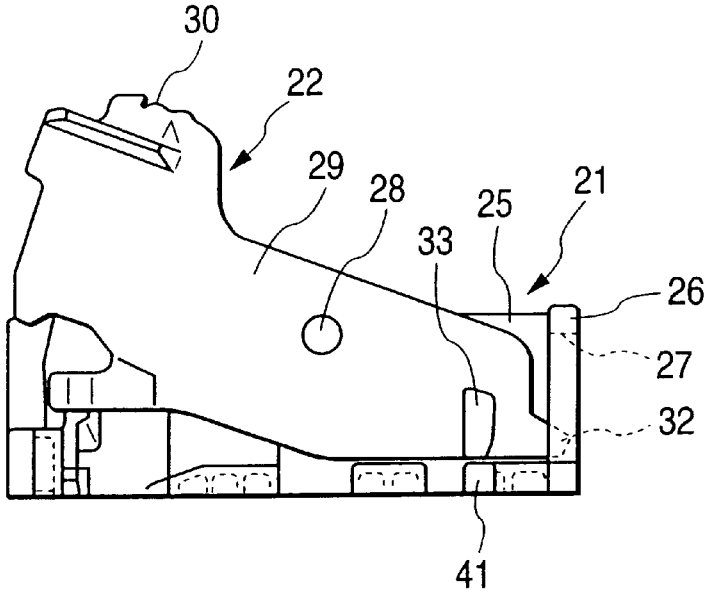
FIG. 1 is a perspective view of one preferred embodiment of the present invention, showing a condition in which a lever and a male connector are assembled together.

The gouging prevention ribs 41 are formed respectively on the opposite side surfaces 25 of the male connector 21, and each of the gouging prevention ribs 41 is disposed in tandem with the corresponding engagement projection 33 of the lever 22. Namely, as shown in FIGS. 1 and 3, the gouging prevention rib 41 is disposed beneath the engagement projection 33 in such a manner that the gouging prevention rib 41 and the engagement projection 33 are juxtaposed to each other in the connector-fitting direction (upward-downward direction). With this construction, when the connectors are to be fitted together, the gouging prevention ribs 41 first enter the hood portion 35, and subsequently the engagement projections 33 enter the hood portion 35.

Figure 4:
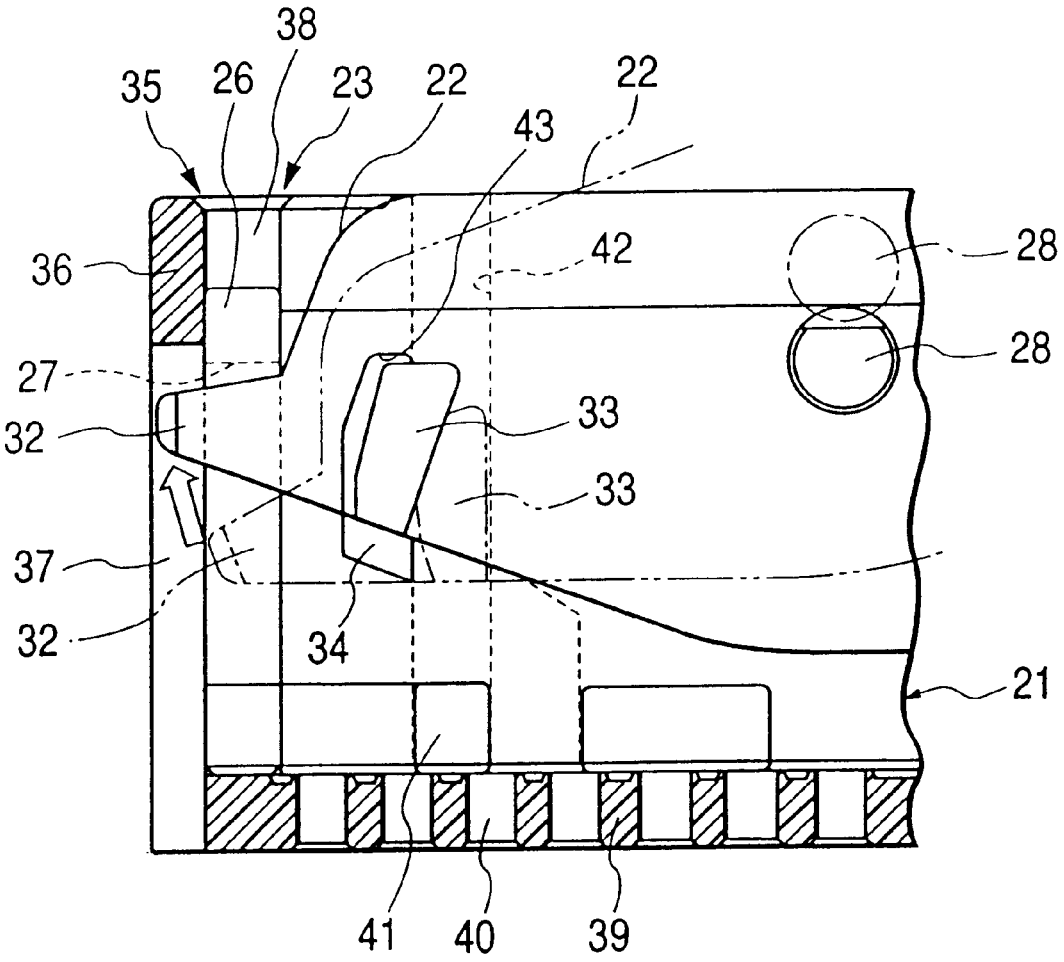
FIG. 4 is a cross-sectional view showing the operation of fitting the male connector into the female connector.
Figure 5:
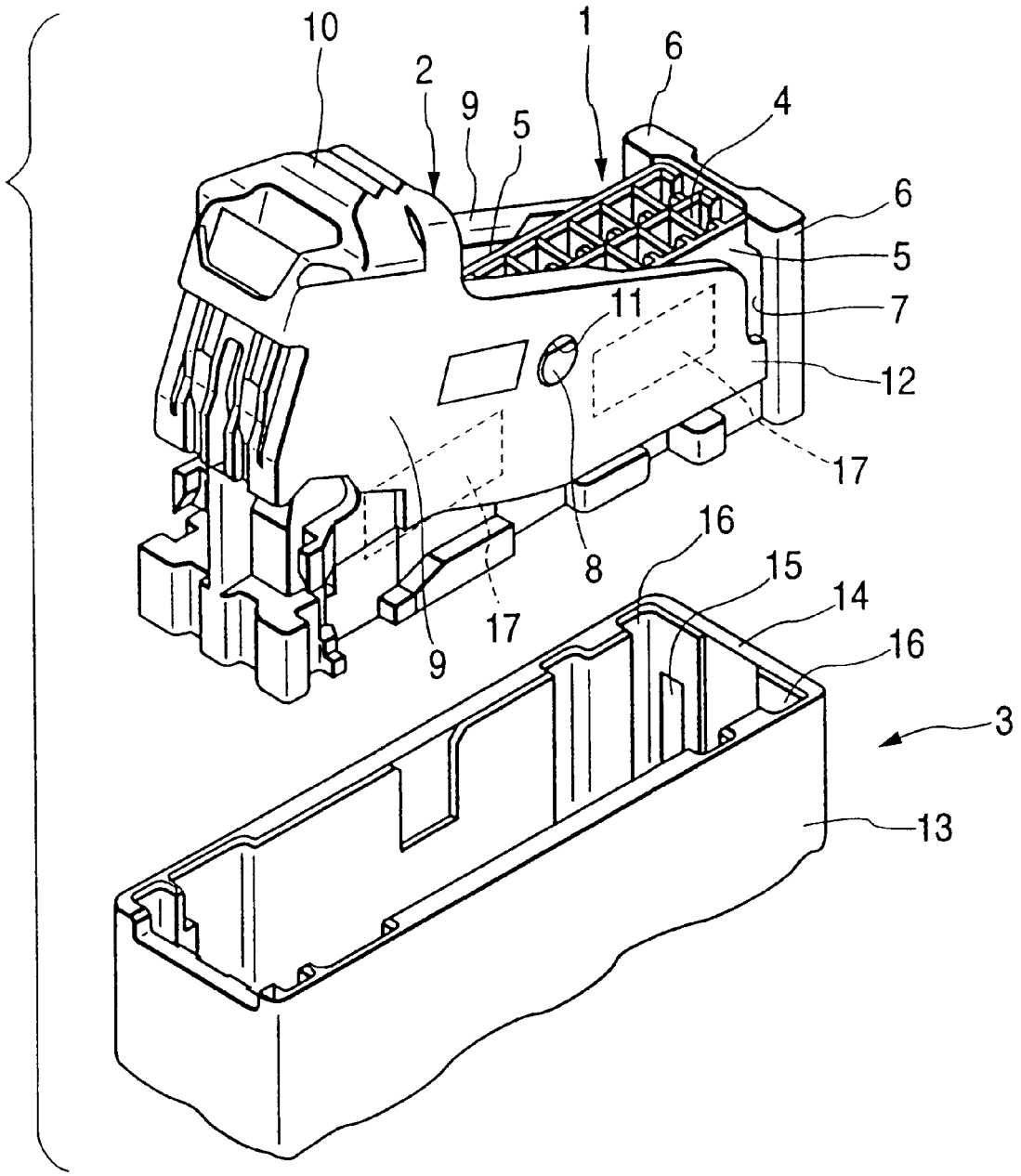
FIG. 5 PRIOR ART
FIG. 5 is a perspective view of a conventional lever fitting-type connector.

The rib grooves 42 are formed in the inner surface of the female connector 23. As shown in FIGS. 3 and 4, the rib grooves 42 are formed in the inner surface of the female connector 23, and extend longitudinally in the connect or fitting direction. Each of the gouging prevention ribs 41 slides along the associated rib groove 42, so that the connectors 21 and 23 can be fitted together smoothly.

In this embodiment, each of the retaining holes 34 (formed in the female connector 23), in which the engagement projections 33 can be retainingly engaged, respectively, is disposed intermediate opposite ends of the corresponding rib groove 42, and communicates with this rib groove 42, as shown in FIGS. 3 and 4. As shown in FIG. 3, the retaining hole 34 is open to the outer surface of the hood portion 35, but is closed at upper and lower sides thereof spaced from each other in the connector-fitting direction. The upper closed surface of this retaining hole serves as a retaining surface 43 for retaining the engagement projection 33. At the time of pivotal movement of the lever 22, the engagement projections 33 are retained respectively by the retaining surfaces 43, and serve as the supporting point for the pivotal movement of the lever 22.

In the above embodiment, the bosses 28 are inserted into the rotation holes 31, respectively, and the projected engagement portions 32 are inserted respectively into the slots 27 to be engaged respectively with the disengagement prevention ribs 26. In this manner, the lever 22 is mounted on the male connector 21. Then, this assembly is inserted into the hood portion 35. At this time, the disengagement prevention ribs 26 of the male connector 21 are inserted respectively into the slots 38 in the hood portion 35 while the gouging prevention ribs 41 of the male connector 21 are inserted respectively into the rib grooves 42 in the female connector 23, as shown in FIG. 3.

As a result of this inserting operation, the gouging prevention ribs 41 pass past the retaining holes 34, respectively, and when the engagement projections 33 are brought into alignment with the retaining holes 34, respectively, the operating portion 30 is pressed to pivotally move the lever 22. Whether or not each engagement projection 33 is brought into alignment with the associated retaining hole 34 can be clearly confirmed by viewing the retaining hole 34 open to the outer surface of the hood portion 35.

When the lever 22 is pivotally moved from a condition, indicated in a broken line (FIG. 4) to a condition, indicated in a solid line, upon depression of the operating portion 30, the engagement projections 33 enter the retaining holes 34, respectively. When the lever 22 is further pivotally moved, the engagement projections 33 are retained by the retaining surfaces 43, respectively, so that the engagement projections 33 serve as the supporting point for the pivotal movement of the lever 22. Namely, because of the leverage in which the operating portion 30 serves as the force-applying point, and the bosses 28 serve as the application point, and the engagement projections 33 serve as the supporting point, the lever 22 is pivotally moved in a direction of an arrow of FIG. 4, and as a result of this pivotal movement, the male connector 21 is fitted into the female connector 23. In this fitted condition, the projected engagement portions 32, formed at the front end of the lever 22, are engaged respectively in the engagement holes 37 in the female connector 23, and therefore are prevented from being disengaged from the female connector 23.

In this embodiment, the engagement projections 33, serving as the supporting point for the pivotal movement of the lever 22, are disposed rather close to the bosses 28 serving as the application point, and therefore the distance between the supporting point and the application point is reduced.

Therefore, the operating force, required for pivotally moving the lever with the operating portion serving as the force-applying point, can be reduced, and the male and female connectors 21 and 23 can be fitted together with a small force.

Therefore, the projected engagement portions and the disengagement prevention ribs, which cooperate with each other to prevent the lever 22 from being disengaged from the male connector 21, do not need to be changed in design, and the requirement for a multi-pole design can be met although the projected engagement portions 32 and the disengagement prevention ribs 26 are provided.

Thus, the gouging prevention ribs 41 are formed on the male connector 21 while the rib grooves 42 for respectively receiving the gouging prevention ribs 41 are formed in the hood portion 35, and therefore the male connector 21 can be smoothly fitted into the hood portion 35 of the female connector 23.

Further, the engagement projections 33 are provided in juxtaposed relation to the gouging prevention ribs 41, respectively, and also each of the retaining holes 34, in which the engagement projection 33 can be retainingly engaged, communicates with the rib groove 42 for receiving the gouging prevention rib 41. Therefore, by inserting the gouging prevention ribs 41 respectively into the rib grooves 42, the engagement projections 33 are engaged respectively in the retaining holes 34. Therefore, the engagement projections 33 can be easily retained relative to the retaining holes 34, respectively.

Each of the engagement projections 33 is disposed in juxtaposed relation to the associated gouging prevention rib 41, and the gouging prevention ribs 41 are first inserted into the hood portion 35, and subsequently the engagement projections 33 are inserted into the hood portion. Therefore, the engagement projections 33 will not interfere with the hood portion 35, and therefore will not be damaged.

In summary, as described above, the engagement projections, serving as the supporting point for the pivotal movement of the lever, are disposed rather close respectively to the bosses serving as the application point, and therefore, the operating force, required for pivotally moving the lever with the operating portion serving as the force-applying point, can be reduced, and the requirement for a multi-pole design can be met.

Further, the engagement projections are provided in juxtaposed relation to the gouging prevention ribs, respectively, and also each of the retaining holes, in which the engagement projection can be retainingly engaged, communicates with the rib groove for receiving the gouging prevention rib. Therefore, by inserting the gouging prevention ribs respectively into the rib grooves, the engagement projections can be easily engaged in the retaining holes, respectively. Moreover, each of the engagement projections is disposed in juxtaposed relation to the associated gouging prevention rib, and therefore, the engagement projections will not interfere with the mating connector, and therefore will not be damaged.

What is claimed is:

1. A lever fitting-type connector in which a lever is pivotally mounted on bosses formed on a connector, and said connector is adapted to be fitted into a mating connector by pivotally moving said lever so that said bosses serve application point, said lever comprising:

an operating portion, serving as a force-applying point for pivoting said lever about a first axis defined by said bosses, formed at a rear end portion of said lever; and a plurality of engagement projections formed respectively on opposite side walls of said lever, and disposed adjacent to said bosses, respectively, wherein at least one of said engagement projections extends along a second axis that is substantially parallel to said first axis;

wherein retaining holes are formed in said mating connector, and said engagement projections are retainingly engaged respectively in said retaining holes, so that said engagement projections serve as a supporting point for the pivotal movement of said lever.

2. A lever fitting-type connector in which a lever is pivotally mounted on bosses formed on a connector, and said connector is adapted to be fitted into a mating connector by pivotally moving said lever with said bosses serving as an application point, said lever comprising:

an operating portion, serving as a force-applying point for pivoting said lever, formed at a rear end portion of said lever; and a plurality of engagement projections formed respectively on opposite side walls of said lever, and disposed adjacent to said bosses, respectively, wherein retaining holes are formed in said mating connector, and said engagement projections are retainingly engaged respectively in said retaining holes, so that said engagement projections serve as a supporting point for the pivotal movement of said lever, and further wherein a plurality of gouging prevention ribs are formed respectively on opposite side surfaces of said connector, and are juxtaposed respectively to said engagement projections in a direction of fitting of said connector, and a plurality of rib grooves for respectively receiving said gouging prevention ribs are formed in an inner surface of said mating connector, and said retaining holes communicate with said rib grooves, respectively.

3. A lever fitting-type connector comprising:

a male connector having side surfaces having bosses formed thereon, and a plurality of gouging prevention ribs formed on and projecting from said side surfaces of said male connector;

a female connector having a hood portion and an open top into which said male connector is fitted, said female connector including a plurality of engagement retaining holes formed in said hood portion, and a plurality of rib grooves, each of said rib grooves being adapted to receive a respective one of said gouging prevention ribs;

a lever having side walls, said lever being pivotally mounted on said bosses of said male connector, said lever further comprising:

an operating portion interconnecting said side walls; and a plurality of engagement projections formed on and projecting from said side walls of said lever, which are engaged in said engagement retaining holes formed in said female connector;

wherein said each of said gouging prevention ribs of said male connector is disposed in a vertically aligned relationship with each of said engagement projections of said lever, and when said male connector is fitted into said female connector, each of said gouging prevention ribs and then each of said engagement slide along each of said rib grooves and enters said hood portion.

* * * * *